US007946523B2

(12) United States Patent
Fabian

(10) Patent No.: US 7,946,523 B2
(45) Date of Patent: May 24, 2011

(54) SELF-ADJUSTING PAYOFF CORE

(75) Inventor: Gabor Fabian, Brampton (CA)

(73) Assignee: Lincoln Global, Inc., City of Industry, CA (US)

( * ) Notice: Subject to any disclaimer, the term of this patent is extended or adjusted under 35 U.S.C. 154(b) by 475 days.

(21) Appl. No.: 11/609,594

(22) Filed: Dec. 12, 2006

(65) Prior Publication Data

US 2008/0135672 A1 Jun. 12, 2008

(51) Int. Cl.
*B65H 75/24* (2006.01)

(52) U.S. Cl. ..... 242/571.4; 242/613; 242/118.11; 242/118.2

(58) Field of Classification Search ..... 242/571, 242/571.3, 571.4, 600, 609, 613, 604, 118.1, 242/118.11, 118.2
See application file for complete search history.

(56) References Cited

U.S. PATENT DOCUMENTS

| | | | | |
|---|---|---|---|---|
| 2,541,963 | A * | 2/1951 | Hendrix | 242/118.2 |
| 3,756,530 | A * | 9/1973 | Ito et al. | 242/118.2 |
| 5,480,106 | A * | 1/1996 | Voissem | 242/571 |
| 6,564,943 | B2 * | 5/2003 | Barton et al. | 206/395 |

FOREIGN PATENT DOCUMENTS

| | | | |
|---|---|---|---|
| CA | 2580895 | | 6/2008 |
| CN | 101200249 | | 6/2008 |
| EP | 430548 | A1 * | 6/1991 |
| GB | 402268 | A * | 11/1933 |

OTHER PUBLICATIONS

Definition of Integral from www.dictionary.com.*
Canadian Application No. 2,580,895; Examiner's Report dated Sep. 24, 2009.
Canadian Application No. 2,580,895; Response to Sep. 24, 2010 Examiner's Report, filed on Mar. 24, 2010.
Canadian Application No. 2,580,895; Notice of Allowance issued Aug. 6, 2010.
Chinese Counterpart Application No. 200710089763.8 , First Office Action dated Feb. 1, 2011 with English translation.

* cited by examiner

*Primary Examiner* — William E Dondero
(74) *Attorney, Agent, or Firm* — Perkins Coie LLP

(57) ABSTRACT

An invention is provided which employs a self-adjusting core section having an outer diameter which essentially matches that, or is larger than that, of the inner diameter of a wire coil, where the self-adjusting core has a vertical slit along the its length to allow the diameter of the core to be adjustable. Bridging the vertical slit are straps secured to the core to determine the core's maximum diameter, and allow the core diameter to be reduced through flexing.

17 Claims, 4 Drawing Sheets

SELF-ADJUSTING PAYOFF CORE

FIELD OF THE INVENTION

The present invention is directed to self adjusting payoff core, more specifically to a self-adjusting payoff core used with wire coils employed in welding operations, and other similar applications.

BACKGROUND OF THE INVENTION

In some welding operations, such as MIG welding, a wire coil is employed to provide a continuous feed of welding wire (electrode) to the welding gun. In these applications, the welding wire is often stored in a large coil configuration, in which the coil of wire is placed in a box or a container having a core section around which the wire is coiled. The core section is employed to maintain coil stability as the wire is pulled out of the box during the welding operation.

However, there are problems associated with this configuration. First, as the wire is pulled from the container the loop diameter of the wire becomes smaller (due to the pulling tension on the wire). Because of this, the wire falls between a gap between the core section and the wire coil, and can fall as far as the bottom of the container. This falling of the wire greatly increases the friction between the wire and the core section, thus increasing the friction force and required feed force to draw the wire out of the container. The gap is created by the use of a core section having a diameter smaller than that of the inner diameter of the wire coil, which is needed to allow the core section to be easily placed in the center of the wire coil. Secondly, the core section can move and/or be tilted during the wire payout which causes similar problems which increase the required feed force. For example, the wire can fall under the core section or be bound by the tilted core section.

Therefore, there is a need for a payoff core configuration which is capable of addressing the above problems.

SUMMARY OF THE INVENTION

The present invention is directed to solve the above problems by providing a low cost and reliable system to allow for low friction and consistent wire payout during a wire feed operation, in wire coil containers of various sizes having wire coils of varying sizes and diameters.

To accomplish this, an embodiment of the present invention employs a self-adjusting core section having an outer diameter which essentially matches that, or is larger than, of the inner diameter of the wire coil, where the self-adjusting core has a vertical slit along its length to allow the diameter of the core to be adjustable. Bridging the vertical slit are straps secured to the core to determine the core's maximum diameter.

Various embodiments of the present invention will be discussed in more detail below.

BRIEF DESCRIPTION OF THE DRAWINGS

The advantages, nature and various additional features of the invention will appear more fully upon consideration of the illustrative embodiments of the invention, which are schematically set forth in the figures, in which.

DETAILED DESCRIPTION OF EXEMPLARY EMBODIMENTS

The present invention relates to a self-adjusting payoff core employed in a wire coil container, such as those employed in welding operations, to allow for low and consistent feed force during wire payout.

Figure 1:
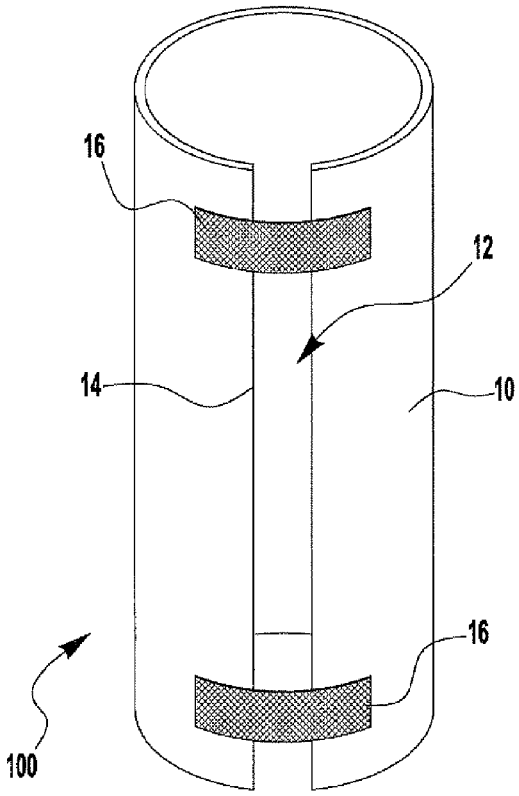
FIG. 1 is a diagrammatical representation of a self-adjusting payoff core according to an embodiment of the invention.
Figure 2:
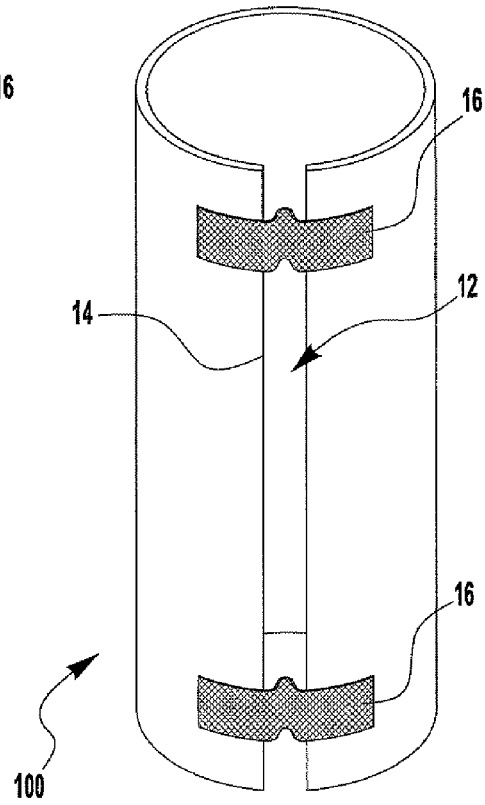
FIG. 2 is a diagrammatical representation of the self-adjusting payoff core of FIG. 1 in a squeezed configuration.

FIGS. 1 and 2 depict a self-adjusting payout core 100 according to an embodiment of the present invention. The core 100 contains a wall section 10 which is essentially cylindrical in shape having a slit section 12 running vertically along a length of the wall section 10. This slit section 12 creates a gap between edges 14 of the wall section 10 such that a diameter and thus cross-section of the core 100 is adjustable, as the gap 14 is reduced or enlarged.

Bridging the gap 14 are a plurality of straps 16 secured to the wall section 10. The straps 16 are made from a flexible material, allowing the wall section 10 to be deflected, thus enabling the gap 14 to be reduced. Further, the straps 16 are strong enough, and secured in such a fashion, so as to maintain a maximum diameter of the core 100. FIG. 2 depicts the core 100 where the gap 14 is reduced, thus the core 100 has a smaller diameter/cross-section then when the straps 16 are extended.

The wall section 10 can be made of any commonly known material having a level of flexibility which allows the wall section 10 to be deflected the needed amount, and sufficient elasticity to rebound after pressure is released. This will ensure that the core 100 can be continually reused, and will continually apply pressure against the inner diameter of the wire coil. For example, the wall section 10 can be made from cardboard, plastic, thin metal sheet, and other similar or comparable materials.

The straps 16 can be made of any known flexible material, such as rubber, cloth, plastic, metal, etc. which allows the wall section 10 to be deflected so that the gap 14 may be reduced by the desired amount. The straps 16 may be secured to the wall section 10 by any known means or methodology, such as an adhesive or fasteners, which ensures that the straps 16 remain secured to the wall 10. In an alternative embodiment the straps 16 are formed integrally with the wall section 10, and both the wall section 10 and straps 16 are made from a material having a sufficient strength and flexibility, as needed.

Figure 6:
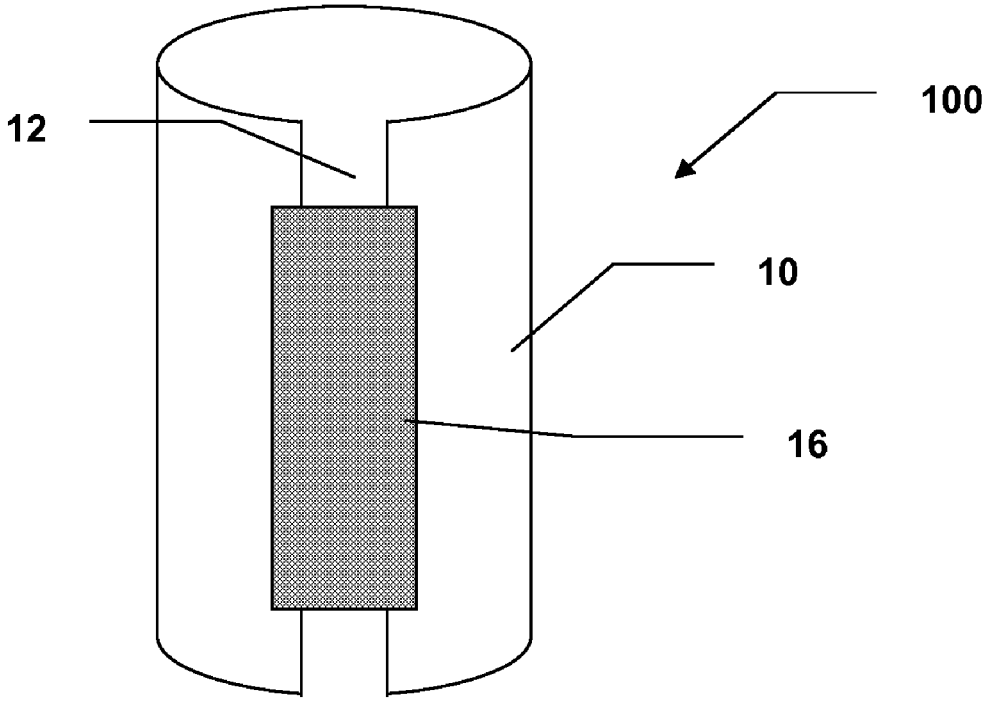
FIG. 6 is a diagrammatical representation of a further exemplary embodiment of a self-adjusting payoff core in accordance with the present invention.

Further, although FIGS. 1 and 2 show two straps 16, the present invention is not limited to this configuration, as the number of straps 16 can be as few as one, and more than two. Moreover, in a further embodiment, the straps/strap 16 have a sufficient width so as to cover the entire length of the slit 12, or at least 50% of the slit length, as shown in FIG. 6. Such configurations would prevent the wire from snagging or otherwise being caught on the straps 16 during payout.

A maximum outer diameter/cross-section of the core 100 is to be selected based on an inner diameter of the wire coil into which the core is to be inserted. In an embodiment of the present invention, the maximum outer diameter of the core 100 is to be approximately the same or larger than the inner diameter of the wire coil, into which it is to be inserted. For example, if the inner diameter of the wire coil is 400 mm, the maximum outer diameter of the core 100 can be in the range of 400 to 405 mm. It is also recognized, however, that the diameter is not required to be exactly the same diameter as the inner diameter of the coil, but can be slightly less, so long as the diameter is sufficiently large enough that the wire is prevented from falling between the core 100 and the wire coil.

During installation, the core 100 is squeezed to allow for easy insertion into the wire coil, and when the core 100 is in its place, the core 100 is allowed to expand to the inner diameter of the coil, thus eliminating any potential gap between the core 100 and the wire coil. Thus, upon installation the diameter of the core 100 is essentially or approximately that of the inner diameter of the wire coil. It is recognized that at some points of contact between the core 100 and the wire coil, the diameters essentially match, but this may not be consistent around the entire circumference of the core 100 due to at least manufacturing accuracies, the shape of the core, and the presence of the gap 14. However, as long as the core 100 diameter is sufficiently large at some points so as to prevent the problems discussed above, the benefits of the present invention will be attained.

Further, in addition to addressing the problems discussed above, the present invention permits the use of a single core 100 along with a plurality of different size wire coils having different inner diameters, thus allowing for easy interchangeability and cost savings.

Figure 3:
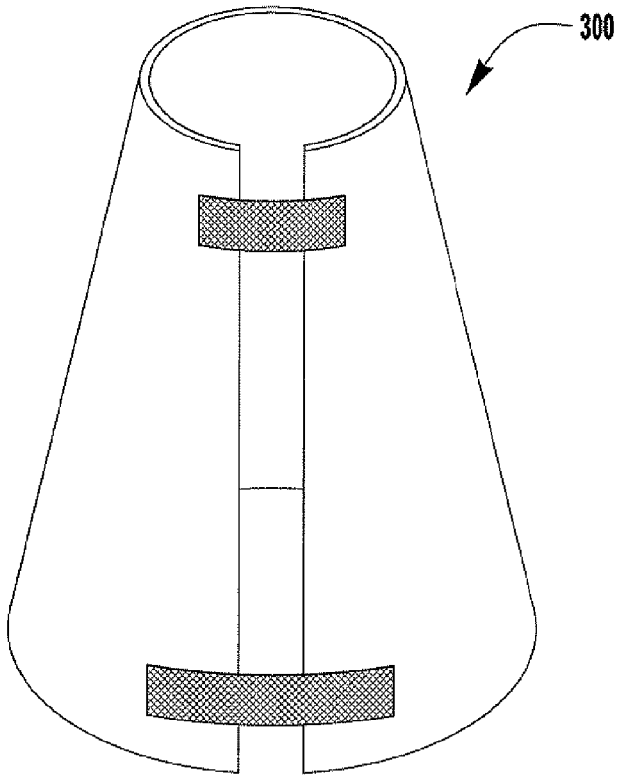
FIG. 3 is a diagrammatical representation of a self adjusting payoff core according to an alternative embodiment of the present invention.

FIG. 3 depicts a further embodiment of the present invention, where the core 300 is similar in construction to the core 100 in FIGS. 1 and 2, but the core 300 is conically shaped. In additional embodiments the self-adjusting core may have a cross-sectional shape which is not circular, but can be of any cross-section which sufficiently supports the wire coil and adequately supports the wire during the wire payout operation. For example, the core can have an octoganol or pentagonal cross-section. It is further understood that it is not necessary for the core 100/300 of the present invention to have an exact geometric cross-section (such as circular, octagonal, etc.). For example, the operation of the present invention would not be compromised if the cross-section was not exactly circular, but was essentially or basically circular. Namely, it is recognized that for various reasons, such as the existence of the gap, the cross-section of the core 100/300 may be approximately circular or octagonal, etc.

Figure 5:
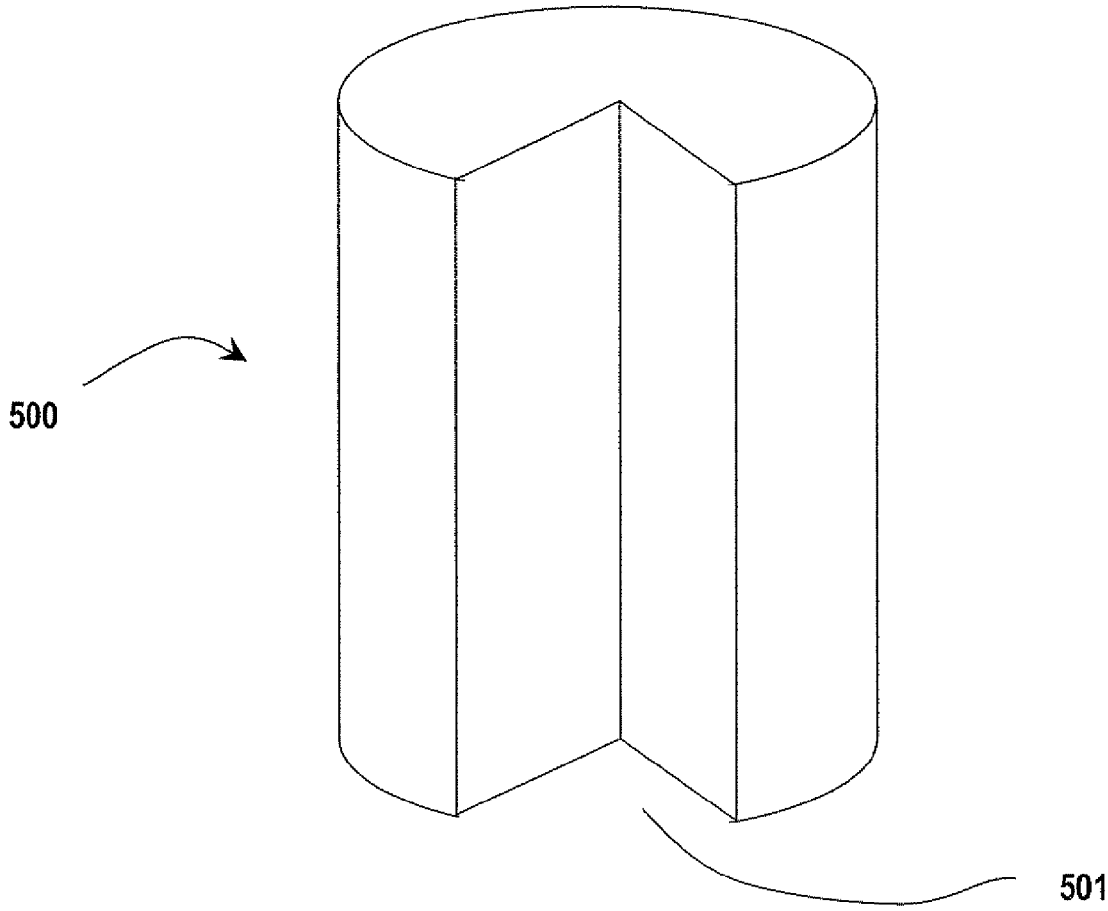
FIG. 5 is a diagrammatical representation of another embodiment of a self-adjusting payoff core in accordance with the present invention.

In a further exemplary embodiment of the present invention, shown in FIG. 5, the core 500 is constructed as a solid body, but is made from a flexible or compressible material. For example, the core 500 may be made from a foam or sponge like substance which is relatively easily compressible. The operation of this embodiment is similar to that described above. Specifically, the compressible core 500 is squeezed or compressed as it is placed within a wire container, and when the squeezing pressure is releases the core 500 returns to its original shape. The compressibility of the core 500 is to be such so that it is relatively easily compressed to allow for its installation and removal, but also have sufficient rigidity so as to allow for the proper payout of wire, as described herein. In a further aspect of this embodiment, the core 500 is not solid, but is shaped similar to that shown in the Figures. Further, in another embodiment the core 500 is solid except for a wedge portion 501. The wedge portion 501 allows the core 500 to compress easier.

Figure 4:
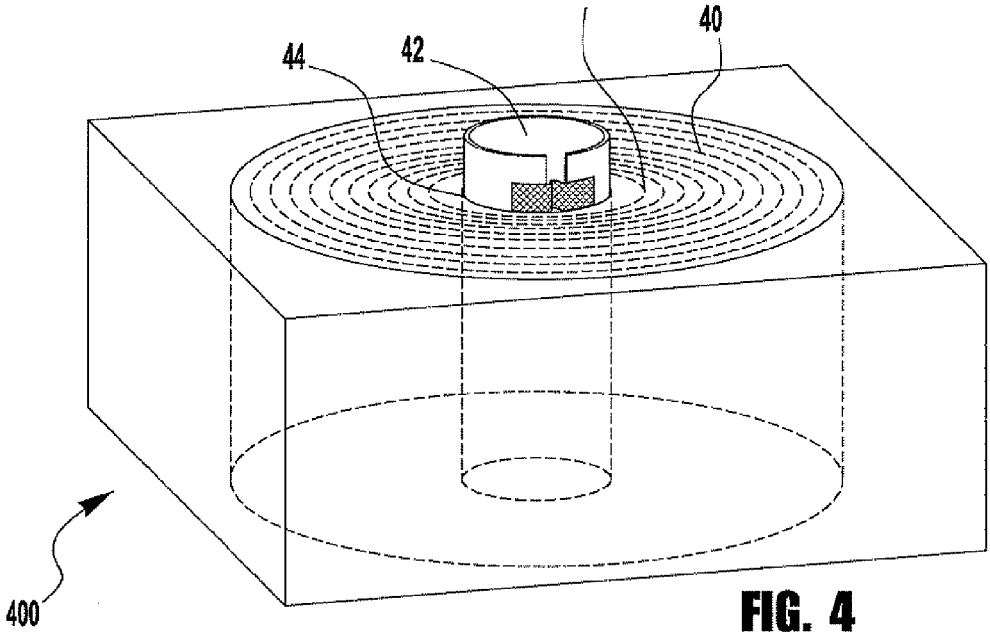
FIG. 4 is a diagrammatical representation of an embodiment of the present invention placed in a wire coil box along with a wire core.

FIG. 4 depicts an embodiment of the present invention in a wire coil container 400. The container 400 can be of any commonly known shape or configuration used to hold a wire coil, such as square, rectangular, circular, octagonal, etc., and can be made of any commonly known or used materials. Within the container 400 is a wire coil 40 of welding wire (or any other wire or material) which is coiled in a cylindrical shape. The wire coil 40 has an inner diameter/space 44 in which a self-adjusting payoff core 42 is placed. As indicated above, the payoff core 42 has a maximum diameter (when the straps are fully extended) which is approximately the same as or larger than an inner diameter of the wire coil 40. Thus, when the core 42 is placed within the center of the coil 40 (while being squeezed) the core 42 essentially eliminates any gap(s) between the core 42 and the coil 40, ensuring that the benefits of the present invention are obtained.

To remove the core 42, the core 42 is squeezed again (reducing the size of the gap) allowing easy removal of the core from the coil 40.

Of course, although the present invention has been discussed with respect to welding wire coils, it is contemplated that the present invention may be used in any applications where a material is coiled and is to be drawn or paid out in a smooth and efficient manner, such that the payout force needed is minimized and similar problems such as those discussed herein are desired to be avoided.

The present invention has been described with certain embodiments and applications. These can be combined and interchanged without departing from the scope of the invention as defined in the appended claims. The invention as defined in these appended claims are incorporated by reference herein as if part of the description of the novel features of the present invention.

I claim:

1. A welding wire configuration comprising:

a coil of welding wire defining an inner diameter of the wire coil; and a self-adjusting payoff core disposed in the wire coil, said core comprising:

a wall section disposed about a central axis to define a vertical length and circumference of the core, the wall section having a gap between one edge of the wall section and another edge of the wall section, the wall section engaging the inner diameter of the wire coil at a plurality of contact points, the contact between the inner diameter and the wall section not being consistent along the circumference; and at least one strap bridging said gap and coupled to said wall section on each side of said gap, the core having a self-adjusting cross-section that adjusts with a change in the inner diameter of the wire coil, the self-adjusting cross-section deflecting and rebounding in response to the change in the inner diameter of the wire coil to continually apply pressure against the inner diameter of the wire coil such that the coil of wire does not vertically fall relative to the core.

2. The self-adjusting payoff core of claim 1, wherein said gap is defined by a slit which extends the entire vertical length of said wall section.

3. The self-adjusting payoff core of claim 1, wherein the cross-section of said core is approximately circular.

4. The self-adjusting payoff core of claim 1, wherein said at least one strap is formed integrally with said wall section.

5. The self-adjusting payoff core of claim 1, wherein said core is approximately conical in shape.

6. The self-adjusting payoff core of claim 1, wherein said at least one strap has a width which is at least 50% of the length of said gap.

7. The self-adjusting payoff core of claim 1, wherein said wall section is made of at least one of cardboard, plastic and metal and wherein said strap is made of either rubber or cloth.

8. A container comprising:

a coil of welding wire having a center portion defining an initial inner diameter; and a self-adjusting payoff core installed within said center portion, said payoff core comprising:

a wall section having a gap between one edge of the wall section and another edge of the wall section, a portion of the wall section defining a space between the core and the inner diameter of the wire coil such that the welding wire cannot fall into the space; and at least one strap bridging said gap and coupled to said wall section on each side of said gap, the core having a self-adjusting cross-section that adjusts with a change in the inner diameter of the wire coil, the self-adjusting cross-section including an initial cross-section defined by the initial inner diameter of the coil of material and another cross-section defined by another inner diameter of the wire coil different than the initial inner diameter to maintain the space between the core and the inner diameter of the wire coil such that the welding wire cannot fall into the space.

9. The wire coil container of claim 8, wherein said strap is flexible allowing said gap to be reduced to allow for insertion of said core into said center portion.

10. The wire coil container of claim 8, wherein said gap is defined by a slit which extends the entire length of said wall section.

11. The wire coil container of claim 8, wherein the cross-section of said core is approximately circular.

12. The wire coil container of claim 8, wherein said at least one strap is formed integrally with said wall section.

13. The wire coil container of claim 8, wherein said core is approximately conical in shape.

14. The wire coil container of claim 8, wherein said at least one strap has a width which is at least 50% of the length of said gap.

15. The wire coil container of claim 8, wherein said wall section is made of at least one of cardboard, plastic and metal and wherein said at least one strap is made of either rubber or cloth.

16. The wire coil container of claim 8, further comprising a container portion surrounding said wire coil.

17. The wire coil container of claim 8, wherein said core comprises at least two of said straps.

* * * * *